US010835953B2

(12) United States Patent
Fuwa et al.

(10) Patent No.: US 10,835,953 B2
(45) Date of Patent: Nov. 17, 2020

(54) MOLTEN METAL FEED PIPE FOR MOLTEN NONFERROUS ALLOY, ASSEMBLY OF MOLTEN METAL FEED PIPES, AND NONFERROUS ALLOY CASTING SYSTEM

(71) Applicant: Toshiba Kikai Kabushiki Kaisha, Tokyo-to (JP)

(72) Inventors: Hisanori Fuwa, Numazu (JP); Shuhei Honma, Numazu (JP); Hiroki Amezawa, Zama (JP)

(73) Assignee: Toshiba Kikai Kabushiki Kaisha, Tokyo-to (JP)

( * ) Notice: Subject to any disclaimer, the term of this patent is extended or adjusted under 35 U.S.C. 154(b) by 0 days.

(21) Appl. No.: 15/452,174

(22) Filed: Mar. 7, 2017

(65) Prior Publication Data

US 2017/0259328 A1 Sep. 14, 2017

(30) Foreign Application Priority Data

Mar. 8, 2016 (JP) ..... 2016-044700

(51) Int. Cl.
*B22D 17/10* (2006.01)
*B22D 17/30* (2006.01)
(Continued)

(52) U.S. Cl.
CPC ..... *B22D 17/10* (2013.01); *B22D 17/203* (2013.01); *B22D 17/30* (2013.01); *B22D 21/007* (2013.01)

(58) Field of Classification Search
CPC ..... B22D 17/10; B22D 17/203; B22D 17/30; B22D 21/007
(Continued)

(56) References Cited

U.S. PATENT DOCUMENTS 3,672,440 A * 6/1972 Miura ..... B22D 17/2023 164/113
4,926,926 A * 5/1990 Zecman ..... B22D 17/2023 164/138
(Continued)

FOREIGN PATENT DOCUMENTS

CN 1978095 6/2007
CN 201201047 3/2009
(Continued)

OTHER PUBLICATIONS

Taiwanese Office Action issued in TW Application No. 106106843 dated Jan. 25, 2018.
(Continued)

*Primary Examiner* — Scott R Kastler
*Assistant Examiner* — Michael Aboagye
(74) *Attorney, Agent, or Firm* — DLA Piper LLP US

(57) ABSTRACT

A molten metal feed pipe for feeding a molten metal of an nonferrous alloy includes an outer tube made of a ferrous material, an inner tube made of a molten metal resistant material, and an intermediate member made of a compact of a fibrous non-organic material, which is disposed between the outer tube and the inner tube. The intermediate member, positioned in the central region of the molten metal feed pipe with respect to the longitudinal axial direction of the molten metal feed pipe, is disposed between the outer tube and the inner tube with the intermediate member being compressed in a radial direction of the molten metal feed pipe.

9 Claims, 5 Drawing Sheets

(51) Int. Cl.
*B22D 21/00* (2006.01)
*B22D 17/20* (2006.01)

(58) Field of Classification Search
USPC ..... 266/236, 280, 286; 222/591
See application file for complete search history.

(56) References Cited

U.S. PATENT DOCUMENTS

| | | | | | |
|---|---|---|---|---|---|
| 4,995,427 | A * | 2/1991 | Berchem | F16L 57/06 | 138/120 |
| 5,012,856 | A * | 5/1991 | Zecman | B22D 17/2023 | 164/113 |
| 5,611,477 | A * | 3/1997 | Wang | B23K 20/08 | 228/107 |
| 6,736,188 | B2 * | 5/2004 | Vining | B22D 17/007 | 164/113 |
| 8,333,920 | B2 * | 12/2012 | Masuda | C21D 8/10 | 266/236 |
| 8,580,187 | B2 * | 11/2013 | Masuda | B22D 17/2023 | 266/236 |
| 8,771,789 | B2 * | 7/2014 | Masuda | C21D 8/10 | 266/236 |
| 2004/0206413 | A1 | 10/2004 | Claussen et al. | | |
| 2005/0285317 | A1 * | 12/2005 | Henderson | F16L 9/14 | 266/280 |

FOREIGN PATENT DOCUMENTS

| | | | | |
|---|---|---|---|---|
| CN | 202278179 | | 6/2012 | |
| CN | 203018732 | | 6/2013 | |
| CN | 203484658 | | 3/2014 | |
| CN | 101410205 | | 4/2019 | |
| DE | 30 00 486 | | 7/1980 | |
| DE | 91 115 41 | | 11/1991 | |
| DE | 196 39 358 | | 3/1998 | |
| JP | S62-165056 | | 10/1987 | |
| JP | S63-046287 | | 2/1988 | |
| JP | H05-76659 | | 10/1993 | |
| JP | H0647515 | * | 2/1994 | B22D 17/10 |
| JP | H06-316815 | | 11/1994 | |
| JP | H08-174173 | | 7/1996 | |
| JP | H08-281411 | | 10/1996 | |
| JP | H09-300060 | | 11/1997 | |
| JP | H09-301782 | | 11/1997 | |
| JP | H10-195418 | | 7/1998 | |
| JP | H10-310805 | | 11/1998 | |
| JP | 2000-266243 | | 9/2000 | |
| JP | 2002-066708 | | 3/2002 | |
| JP | 2002-316248 | | 10/2002 | |
| JP | 2007-152377 | | 6/2007 | |
| JP | 2011-131265 | | 7/2011 | |
| JP | 5015138 | | 6/2012 | |
| JP | 2012-219922 | | 11/2012 | |
| WO | WO 2007/111257 | | 4/2007 | |
| WO | WO 2015/084260 | | 6/2015 | |

OTHER PUBLICATIONS

English Language Abstract of CN 202278179 published Jun. 20, 2012.
English Language Abstract of CN 203484658 published Mar. 19, 2014.
English language machine translation of JP 5015138 issued Jun. 15, 2012.
Japanese Office Action issued in JP 2016-044700 dated Apr. 6, 2018.
Japanese Office Action issued in JP 2016-044700 dated Jul. 3, 2018.
Chinese Office Action issued in CN 2017101356106 dated Jul. 3, 2018.
English Language Abstract of CN 203018732 published Jun. 23, 2013.
German Office Action issued in DE 10 2017 203 802.0 dated Jul. 24, 2018.
Chinese Office Action issued in CN 201710135610.6 dated Mar. 8, 2019.
Chinese Office Action issued in CN 201710135610.6 dated Sep. 4, 2019.
Chinese Office Action in CN Application No. 201710135610.6 dated Apr. 2, 2020.

* cited by examiner

MOLTEN METAL FEED PIPE FOR MOLTEN NONFERROUS ALLOY, ASSEMBLY OF MOLTEN METAL FEED PIPES, AND NONFERROUS ALLOY CASTING SYSTEM

CROSS REFERENCE TO RELATED APPLICATIONS

This application is based upon and claims the benefit of priority from Japanese Patent Application No. 2016-044700, filed on Mar. 8, 2016, the entire contents of which are incorporated herein by reference.

BACKGROUND OF THE INVENTION

Field of the Invention

The present invention relates to a molten metal feed pipe for feeding a molten nonferrous alloy, an assembly of the molten metal feed pipes, and a nonferrous alloy casting system including the assembly.

Background Art

In recent years, a direct feeding method is spreading. The direct feeding method feeds a molten metal from a melting furnace or a holding furnace through a molten metal feed pipe to a casting machine, such as a die-casting machine, without using a ladle. The direct feeding method is advantageous in that the molten metal is rarely exposed to air and the temperature of the molten metal would not lower, and in that the method can supply a clean molten metal without entraining oxide films and slags floating near the molten metal surface in a furnace. In execution of the direct feeding method, leakage of the molten metal from the molten metal feed pipe should be prevented. Thus, the molten metal feed pipes constituting a molten metal feed piping should be securely connected to each other.

Japanese Patent No. JP5015138B (hereinafter referred to as "Patent Document 1") describes a molten metal feed pipe for feeding a molten aluminum alloy that includes an inner tube formed of a ceramic material having high erosion resistance to molten aluminum, and an outer tube formed of a steel material having high strength and toughness. The outer tube made of a steel material protects the inner tube made of a ceramic material poor in toughness from the impact load at the die-casting shot. In addition, since large fastening force can be applied to steel outer tubes, leakage of molten metal from the connection between the molten metal feed pipes can be reliably prevented.

When the molten metal feed pipe of Patent Document 1 is heated by a molten metal, a gap is generated between the outer tube and the inner tube due to thermal expansion difference. When molten metal flows into the gap, the steel outer tube is eroded by the molten metal. In order to prevent this, the molten metal feed pipe of Patent Document 1 has ring-shaped grooves formed between the inner tube and the outer tube on both ends of the molten metal feed pipe, and a fibrous sheet made of a non-organic material is inserted into each groove. Even when a gap is formed between the inner tube and the outer tube due to increase in temperature of the molten metal feed pipe, the fibrous sheet expands in radial directions with the temperature rising to prevent the molten aluminum, which may erode the outer tube, from penetrating into the gap. A Ni alloy layer is formed on the inner circumference of the outer tube of the molten feed pipe of Patent Document 1, and the Ni alloy layer carries TiC particles. Even if the molten metal penetrate into the gap across the fibrous sheet, erosion of the outer tube by the molten aluminum can be prevented by the TiC particles carried by the Ni alloy layer and having repellency to the molten metal.

The molten metal feed pipe described in Patent Document 1 has still room for improvement in the below respects. One is that the production cost of the molten metal feed pipe is increased by forming a Ni alloy layer in the inner circumference of the outer tube and by applying TiC particles to the Ni alloy layer. The other is that, when the temperature of the molten metal feed pipe is increased, the inner tube may be displaced in a longitudinal axial direction of the molten metal feed pipe, because of a gap formed between the inner tube and the outer tube in an area other than the both longitudinal ends of the molten metal feed pipe.

SUMMARY OF THE INVENTION

The object of the present invention is to protect the outer tube made of a ferrous material from a molten metal and to prevent relative displacement of the outer tube and the inner tube in the longitudinal axial direction of the molten metal feed pipe, while avoiding increase in production cost of the molten metal feed pipe.

In one embodiment of the present invention, there is provided a molten metal feed pipe for feeding a molten metal of an nonferrous alloy, comprising: an outer tube made of a ferrous material; an inner tube made of a molten metal resistant material; and an intermediate member disposed between the outer tube and the inner tube in at least a central region of the molten metal feed pipe with respect to a longitudinal axial direction of the molten metal feed pipe, the intermediate member comprising a compact of a fibrous non-organic material. The intermediate member is disposed between the outer tube and the inner tube with the intermediate member being compressed in a radial direction of the molten metal feed pipe.

In another embodiment of the present invention, there is provided an assembly including the aforementioned two molten metal feed pipes connected to each other. The assembly further includes: a fastener, connecting the two molten metal feed pipes with each other, that generates fastening force to press opposing end faces of the outer tubes of the two molten metal feed pipes against each other; and a packing interposed between opposing end faces of the inner tubes of the two molten metal feed pipes with the packing being compressed by the fastening force, the packing comprising a compact of a fibrous non-organic material.

In yet another embodiment of the present invention, there is provided an nonferrous alloy casting system, which includes: a furnace for storing a molten metal of a nonferrous alloy; a casting machine; and a molten metal feed piping for feeding the molten metal from the furnace to the casting machine, wherein the molten metal feed piping includes an assembly comprising the aforementioned two molten metal feed pipes connected to each other.

According to the above embodiments, since the intermediate member comprising the compact of a fibrous non-organic material is disposed between the outer tube and the inner tube with the intermediate member being compressed in the radial directions of the molten metal feed pipe, repulsive force of the intermediate member generates frictional force between the intermediate member and the outer tube, as well as between the intermediate member and the inner tube. Thus, displacement of the inner tube relative to the outer tube can be prevented. In addition, since the intermediate member is used in the compressed state, it is difficult for the molten metal to penetrate into the space between the outer tube and the inner tube, and thus erosion of the outer tube caused by the intruding molten metal would hardly occur.

DETAILED DESCRIPTION OF EMBODIMENTS

Embodiments of the present invention will be described herebelow with reference to the drawings.

The overall structure of a nonferrous alloy casting system is firstly described with reference to FIGS. 1 and 2.

Figure 1:
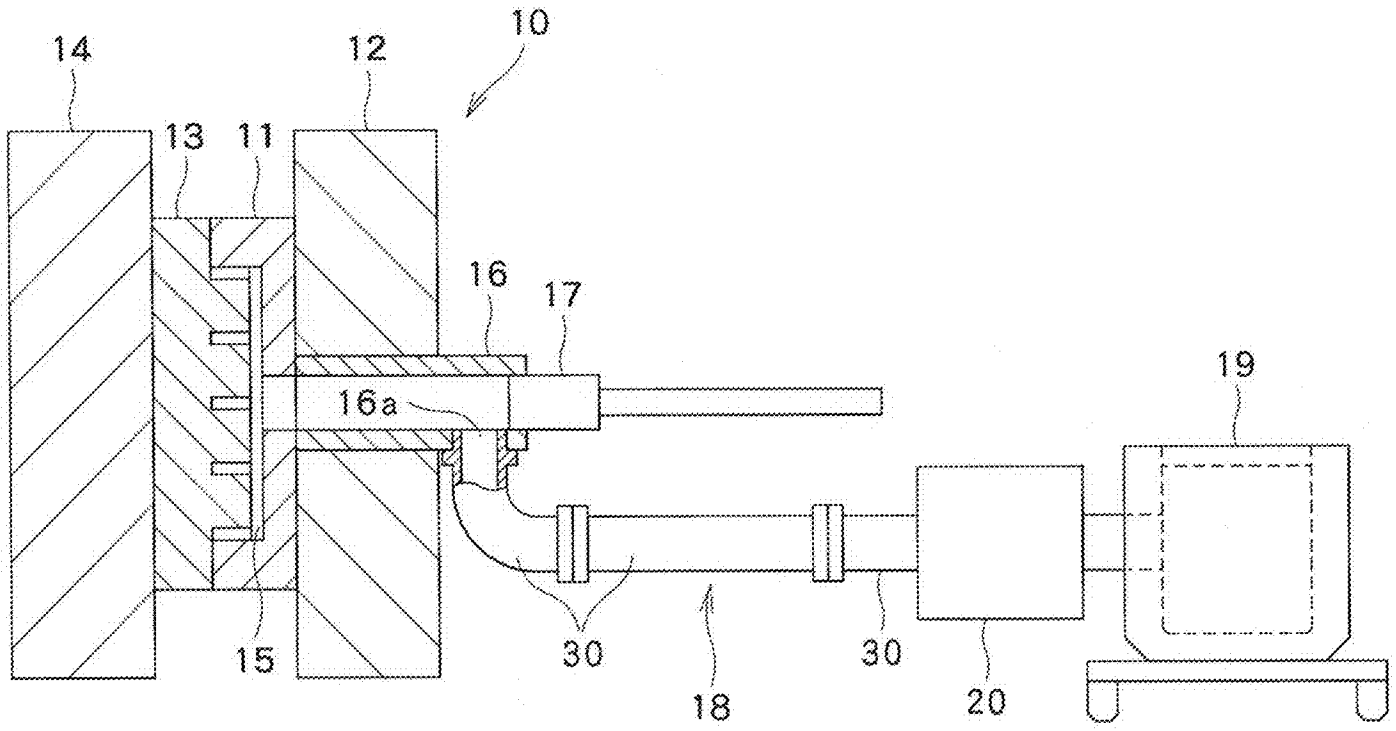
FIG. 1 is a schematic side view of a nonferrous alloy casting system.

As shown in FIG. 1, the nonferrous alloy casting system includes a die-casting machine 10. The die-casting machine 10 may be of a horizontal clamping/injection type, which has been widely used as a die-casting machine of a cold chamber type.

The die-casting machine 10 includes a stationary platen 12 holding a stationary die 11, and a moving platen 14 holding a moving die 13. The interior space of a sleeve 16 is in communication with a cavity 15 formed between the stationary die 11 and the moving die 13. The sleeve includes a plunger 17 for injecting a molten metal filling the sleeve 16 into the cavity 15. Although the die-casting machine 10 also includes other constituent elements, such as a drive mechanism of the moving die 13, a drive mechanism of the plunger 17, etc., which are well-known to those skilled in the art. Illustration and omitted.

A molten metal port 16*a* is disposed on a lower part of the sleeve 16. A furnace 19 such as a melting furnace or a holding furnace is connected to the molten metal port 16*a* through a molten metal feed piping 18. The upper opening of the furnace 19 is closed by a lid, so that the inside of the furnace 19 is substantially isolated from the surrounding environment. The molten metal feed piping 18 is provided thereon with a molten metal feeder 20 (e.g., an electromagnetic molten metal feeder) that feeds a molten nonferrous alloy (e.g., molten aluminum alloy, zinc alloy or magnesium alloy) stored in the furnace 19 to the sleeve 16.

The molten metal port 16*a* is preferably oriented vertically downward, that is, the center of the molten metal port 16*a* is located at the lowermost part of the sleeve 16. However, not limited thereto, it is sufficient that the center of the molten metal port 16*a* is located on a lower half of the sleeve.

The upstream end of the molten metal feed piping 18 is connected to the furnace 19 at a height position lower than a surface level of the molten aluminum stored in the furnace 19. Thus, the molten aluminum in the furnace 19 can be transported by the molten metal feeder 20 to the sleeve 16 through the molten metal feed piping 18, without exposing the molten aluminum to atmospheric air.

In the casting system including the molten metal feed apparatus of the aforementioned so-called "direct feeding type", a high-quality molten metal can be supplied to the casting machine so that a high-quality casting can be produced.

Figure 3:
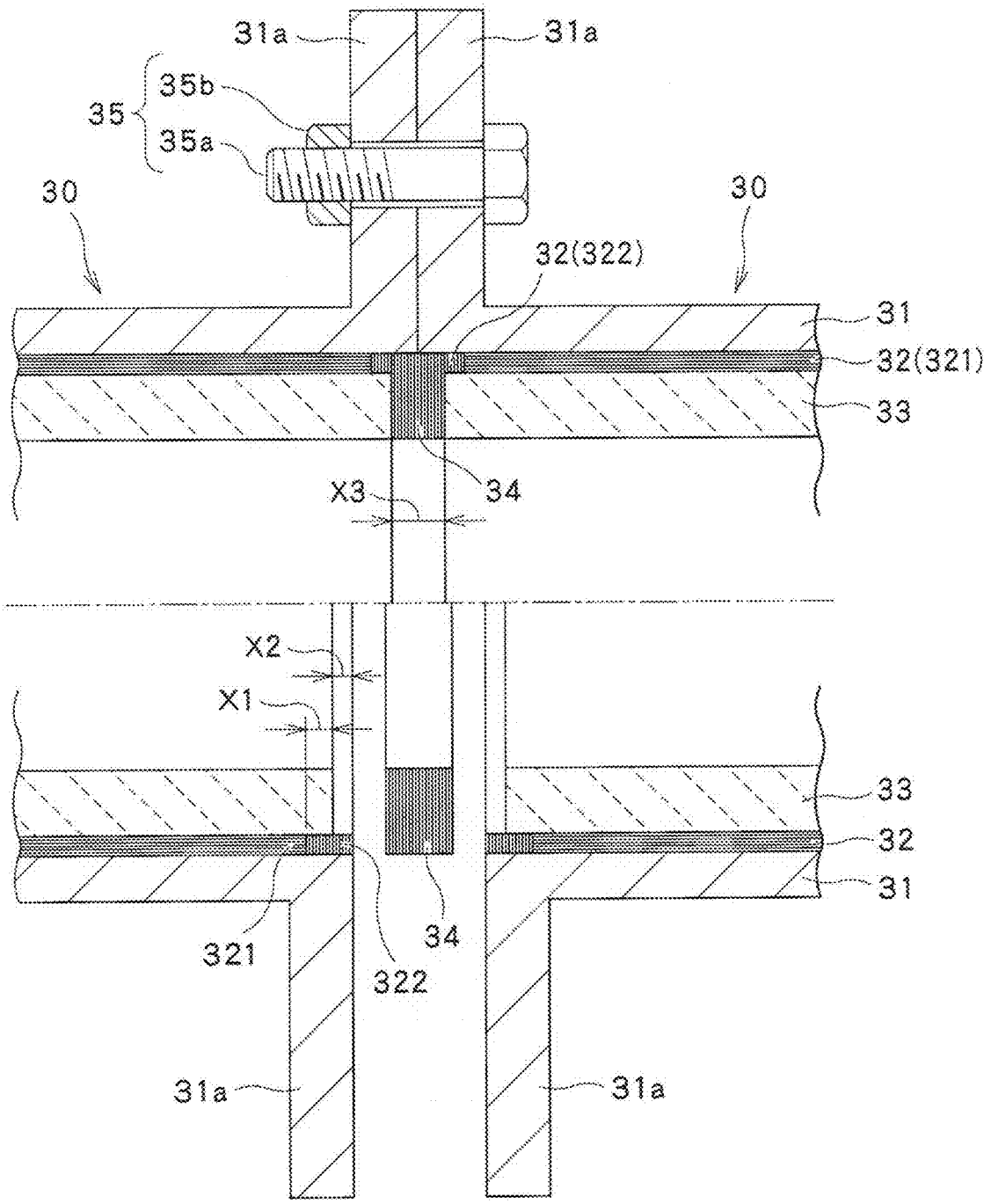
FIG. 3 is a cross sectional view showing a structure of a molten metal feed pipe.
Figure 4A:
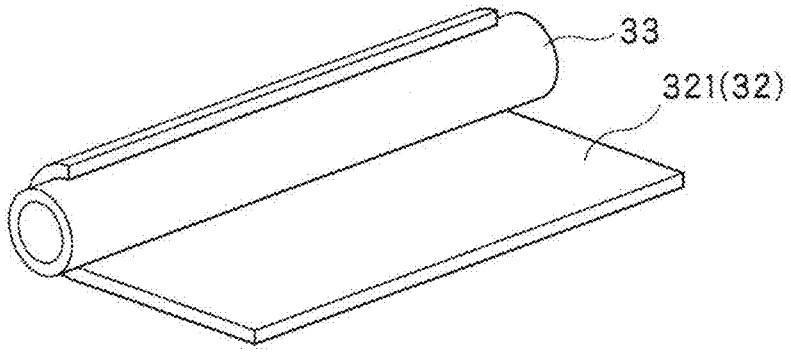
FIGS. 4*a*-4*d* are schematic diagrams for explaining a method of manufacturing the molten metal feed pipe as a straight pipe.
Figure 4B:
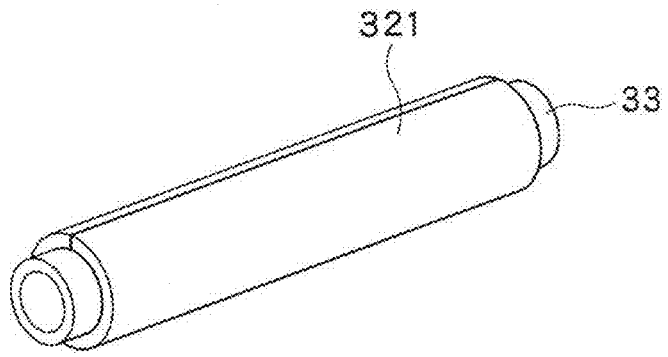
Figure 4C:
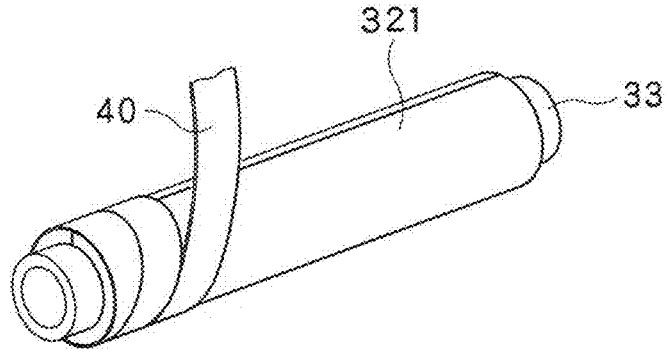
Figure 4D:
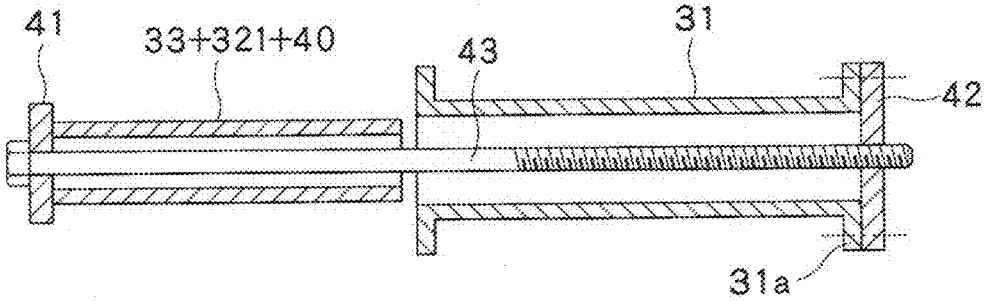

The molten metal feed piping 18 is formed by connecting a plurality of molten metal feed pipes 30. FIG. 3 shows the structure of a connection between the connected two molten metal feed pipes 30 and its vicinity. The part below a dashed centerline of FIG. 3 shows the molten metal feed pipes 30 before connected, while the part above dashed centerline shows the molten metal feed pipes 30 after connected.

The molten metal feed pipe 30 has a three-layered structure including an outer tube 31, an intermediate member 32 and an inner tube 33.

The outer tube 31 is formed of a ferrous material, preferably, a steel material. As the steel material, austenite stainless steel is preferably used if oxidation resistance under high temperatures is specifically important. The outer tube 31 may be formed of cast iron.

The inner tube 33 is made of a material having resistance to a molten metal (specifically, erosion resistance to a molten metal to be transported by the molten metal feed pipe 30), such as a ceramic material. The ceramic material may contain at least one of alumina, silicon nitride, silica and zirconia.

In a case where a molten nonferrous alloy other than aluminum is transported through the molten metal feed pipe 30, another material may be used for the inner tube 33, in consideration of wettability and reactivity to the nonferrous alloy material. For example, in a case where the molten metal is molten magnesium alloy, the material of the inner tube 33 may be a ceramic material other than a silica-based material, or a stainless steel.

The intermediate member 32 interposed between the outer tube 31 and the inner tube 32 may include a central portion 321 which is disposed on a central region of the molten metal feed pipe with respect to a longitudinal axial direction of the molten metal feed pipe 30, and two end portions 322 which are disposed on both ends of the molten metal feed pipe 30.

The intermediate member 33 may be a compact formed by compressing a fibrous non-organic material into a sheet shape (e.g., a sheet-like shape, a felt-like shape or a blanket-like shape). The fibrous non-organic material constituting the intermediate member 32 preferably contains at least one of alumina, silicon nitride and silica (silicon dioxide). A compact of such a fibrous non-organic material is well known and commercially available from member corporations of the Refractory Ceramic Fiber Association, Japan.

It is preferable that diameter of fibers constituting the fibrous-non-organic material is in a range from 1 μm to 500 μm. If the fiber diameter is less than 1 μm, strength of the fiber is so low that it is difficult to maintain its shape. On the other hand, if the fiber diameter is greater than 500 μm, toughness of the fiber is so low that the fiber is likely to be broken when it is subjected to the impact load at the die-casting shot.

In the manufacture of the molten metal feed pipe 30, the sheet shaped compact constituting the central portion 312 of the intermediate member 32 is wound on the outer circumference of the inner tube 33. At this time, a single compact may be wound on the outer circumference of the inner tube 33. Alternatively, plural compacts may be wound on the outer circumference of the inner tube 33.

The inner tube 33, around which the central portion 321 of the intermediate member 32 is wound, is inserted into the outer tube 31 with an interference (in other words, under the condition that the compact forming the central portion 321 is compressed to have a higher density than its free state), so that the outer tube 31, the central portion 321 and the inner tube 33 are integrated. In order to ensure a sufficient interference, the intermediate member 32 in a free state has a thickness that is larger than a half (½) of the difference between the external diameter of the inner tube 33 and the internal diameter of the outer tube 31.

The compact of the fibrous non-organic material constituting the central portion 321 of the intermediate member 32 does not have adhesiveness. However, as described above, since the central portion 321 is fitted into the inside of the outer tube 31 while it is compressed, contact pressure is generated between the central portion 321 and the outer tube 31 as well as between the central portion 321 and the inner tube 33 by the repulsive force against the compression. The frictional force generated due to the contact pressure prevents displacement of the inner tube 33 relative to the outer tube 31.

The density of the compact constituting the central portion 321 of the intermediate member 32 is preferably in a range from 100 kg/m$^2$ to 250 kg/m$^2$, when the compact is being interposed between the outer tube 31 and the inner tube 33. If the density is less than 100 kg/m$^2$, the repulsive force is so small that the sufficient frictional force cannot be generated between the central portion 312 of the intermediate member 32 and the outer tube 31 as well as between the central portion 312 of the intermediate member 32 and the inner tube 33. On the other hand, if the density is greater than 250 kg/m$^2$, there is no performance problem, but the fitting operation (assembling) is difficult, resulting in cost increase.

The frictional force acting between the central portion 312 of the intermediate member 32 and the outer tube 31 as well as between the central portion 312 of the intermediate member 32 and the inner tube 33 is preferably not less than 20 N/cm$^2$. If the frictional force is less than 20 N/cm$^2$, displacement of the inner tube 33 may occur by impact load at the die-casting shot.

Since the central portion 321 of the intermediate member 32 is formed of the aforementioned fibrous non-organic material having both the heat resistance and the toughness, there is no possibility that the intermediate member 32 is damaged by a thermal expansion difference between the outer tube 31 and the inner tube 33. In addition, it is required for the central portion 321 to keep the positional relationship between the outer tube 31 and the inner tube 33 within an allowable range regardless of the temperature (normal or high). The aforementioned fibrous non-organic material can keep its shape without settling or deterioration (without creep deformation), even under a working temperature range as high as 700° C. to 800° C. (corresponding the molten aluminum temperature). In addition, the aforementioned fibrous non-organic material thermally expands when heated. Thus, even when the gap between the outer tube 31 and the inner tube 33 varies because of the thermal expansion difference between the outer tube 31 and the inner tube 33, the intermediate member 32 follows the variation to expand or contract in its thickness direction. Thus, even when the temperature of the molten metal feed pipe 30 varies, the above-described frictional force can be maintained to such an extent that the relative displacement of the outer tube 31 and the inner tube 33 in the longitudinal axial direction can be prevented.

The central portion 321 of the intermediate member 32 wound around the inner tube 33 as described above is discontinuous in the circumferential direction. Namely, when the rectangular central portion 321 having a width corresponding to the circumferential length of the outer circumference of the inner tube 33 is wound around the inner tube 33, opposed sides of the rectangle abut to each other. Since there is a gap between the abutting sides, there is a possibility that a molten metal penetrate into the gap from the end of the molten metal feed pipe 30.

The end portions 322 prevent penetration of the molten metal into the aforementioned gap. Each end portion 322 may be produced by punching or cutting the sheet shaped compact into an annular (ring) shape. Since the thus produced end portion 322 is circumferentially continuous, the end portion 322 can prevent the penetration of the molten metal into the aforementioned gap of the central portion 321.

As described above, it is preferable that the end portion 322 has an annular shape free of discontinuity (seam). However, the end portion 322 may have a seam, if the aforementioned gap of the central portion 321 and a circumferential position of the seam of the end portion 322 are sufficiently separated from each other (e.g., if they are diametrically opposed).

In order to mount the end portion 322, the dimension in the longitudinal axial direction (i.e., the whole axial length) of the central portion 321 is set shorter than the whole axial length of the inner tube 33 by, e.g., 2 to 30 mm. The both end parts of the inner tube 33 are thus left uncovered (not covered with the central portion 321). The axial length of each uncovered part is 1 to 15 mm (see X1 in FIG. 3). The annular end portion 322, which has an external diameter substantially identical to the internal diameter of the outer tube 31 and an internal diameter substantially identical to the external diameter of the inner tube 33, can be mounted on the uncovered part.

It is preferable that the thickness (i.e., the dimension in the longitudinal axial direction) of the end portion 322 is equal to or larger than the axial length (in the above example, from 1 mm to 15 mm) of the uncovered part of the outer circumference of the inner tube 33, and is within a range from 1 mm to 15 mm. The axial compression degree of the end portion 322 when the adjacent molten metal feed pipes 30 are being connected depends on the thickness of the end portion 322. The axial compression degree of the end portion 322 may be large, which is approximately the same as the radial compression degree of the central portion 321 or the axial compression degree of a packing member 34 (described later). Alternatively, the end portion 322 may be axially compressed slightly. If the thickness of the end portion 322 is less than 1 mm, strength of the packing member is low, assembling is difficult, and no satisfactory performance can be achieved. In consideration of the use of the commercially available compact made of the fibrous non-organic material having a sheet-like shape, a felt-like shape or a blanket-like shape, the thickness of the end portion 322 is preferably not more than 15 mm.

Regarding molten metal sealing performance, the end portion 322 having a thickness greater than 15 mm has no problem. However, the larger the thickness of the end portion 322 is, the shorter the length of the central portion 321 is. Thus, since contact areas between the central portion 321 and the outer tube 31 as well as between the central portion 321 and the inner tube 33 reduce, the frictional force reduces. Therefore, it is preferable that the thickness of the end portion 322 is determined such that the resultant length of the central portion 322 ensures a sufficient friction force to prevent displacement of the inner tube 33 relative to the outer tube 31. It is preferable that the central portion 321 has a length that is not less than 80% of the whole axial length (the length in the longitudinal axial direction) of the molten metal feed pipe 30.

The compact of the fibrous non-organic material constituting the central portion 321 of the intermediate member 32 may be coated or impregnated with a heat resistant adhesive or a mortar material. For example, if the central portion 321 is adhered to the inner tube 33, the workability of subsequent fitting of the inner tube 33 into the outer tube 31 is improved. However, such a material may harden the compact to deteriorate its deformability. In this case, the central portion 321 cannot sufficiently follow the expansion of the gap between the outer tube 31 and the inner tube 33 when the molten metal feed pipe is heated. In this case, the friction force between the central portion 321 and the outer tube 31 as well as between the central portion 321 and the inner tube 33 might become zero or significantly decrease. Thus, it is preferable that an adhesive or a mortar-based hard material is applied at most to an adhesion surface of the central portion 321 to the inner circumference of the outer tube 31, or an adhesion surface of the central portion 321 to the outer circumference of the inner tube 33.

The whole axial length of the inner tube 33 is smaller than the whole axial length of the outer tube 31 by 0.2 mm to 10 mm (see X2 in FIG. 3). The outer tubes 31 of the adjacent molten metal feed pipes 30 are fastened by a fastener 35 in such a manner that the packing member 34 is sandwiched between opposing end faces of the inner tubes 33 of the adjacent molten metal feed pipes (and between opposing end faces of the end portions 322 of the intermediate members 32). The packing member 34 can be formed of the same material as that of the aforementioned intermediate member 32. The lamination direction of the compacts constituting the packing member 34 is preferably the thickness direction of the packing member 34, i.e., the longitudinal axial direction of the molten metal feed pipe 30.

If the difference between the whole axial lengths of the outer tube 31 and the inner tube 33 is less than 0.2 mm (this means that a step having a height difference less than 0.1 mm is formed between the end faces of the outer tube 31 and the inner tube 33 on each end), the outer tube 31 and the inner tube 33 are simultaneously subjected to a shot impact of the casting machine, whereby the inner tube 33 made of a fragile ceramic material may be damaged. On the other hand, if the difference between the whole axial lengths of the outer tube 31 and the inner tube 33 is greater than 10 mm, the thickness of the packing member 34 for filling the step has to be increased. In this case, the area to be in contact with the molten nonferrous alloy increases, resulting in deterioration and abrasion.

The fibrous non-organic material constituting the intermediate member 32 or the packing member 34 is preferably mixed with ceramic powder such as boron nitride powder. This results in decrease of wettability of the intermediate member 32 to the molten nonferrous alloy, and thus improvement erosion resistance. Even if ceramic powder is mixed with the fibrous non-organic material, the decrease in the resiliency of the resultant compact is very small. Thus, there is no performance problem.

The intermediate member 32 or the packing member 34 may be formed by laminating a plurality of the sheet shaped compacts of the fibrous non-organic material. In this case, ceramic powder such as boron nitride powder may be disposed between the sheet shaped compacts of the fibrous non-organic material.

In the illustrate example, the fastener 35 comprises plural pairs of screw bolts 35*a* and nuts 35*b*. A plurality of holes are drilled at equal circumferential intervals in a flange 31*a* provided around the outer tube 31 at the end thereof. The screw bolts 35*a* are inserted through the holes, respectively. The nuts 35*b* are engaged with the screw bolts 35*a* and are fastened, respectively. Thus, the opposing flanges 31*a* are brought into contact with each other to be securely coupled to each other. At this time, since the resilient packing member 34 is interposed between the opposing end faces of the inner tubes 33 in order that the opposing end faces of the inner tubes 33 are not in direct contact with each other, there is no possibility that each inner tube 33 is damaged. Since the outer tube 31 is formed of a ferrous material, preferably a steel material, the outer tube 31 will not be damaged, even though the fastening force generated by the fastener 35 (in this case, the axial force of the screw bolt 35*a*) is applied.

The faster (screw bolt 35*a*) is preferably made of a material having a thermal expansion coefficient equal to or less than that of the outer tube 31. If the thermal expansion coefficient of the material constituting the fastener is greater than that of the material forming the outer tube 31, the fastening force decreases to loosen the fastening when heated to the use temperature. In this case, the molten metal may leak from the gap between the loosened opposing flanges 31*a*.

Not limited to the screw bolts 35*a* and the nuts 35*b*, any type of fastener may be used, as long as the fastener acts on the outer tubes 31 of the adjacent molten metal feed pipes 30 to apply the fastening force such that the opposing contact surfaces of the outer tubes 31 (surfaces that are in direct contact with each other without any packing therebetween) press against each other. For example, the fastener may be a clamp or a spring that generates force by which the opposing flanges 31*a* press against each other.

The thickness of the packing member 34 (i.e., the dimension thereof in the longitudinal axial direction) is set such that the thickness of the packing member 34 when compressed by the fastening force of the molten metal feed pipes (e.g., axial force caused by fastening the bolt) is equal to the difference between the whole axial lengths of the inner tube 33 and the outer tube 31 (which is equal to distance X3 between the end faces of the inner tubes 33 of the adjacent molten metal feed pipes 30). The density of the packing member 34 increases upon being crushed (compressed), so that infiltration of the molten nonferrous alloy into the packing member 34 is more reliably prevented. It is preferable that the thickness of the packing member 34 and the distance X3 between the end faces are determined such that the density of the crushed packing member 34 is in a range from 100 kg/m$^2$ to 250 kg/m$^2$. If the compression of the packing member 34 is insufficient, the molten nonferrous alloy can easily penetrate into gaps in the non-organic material fibers. If the molten nonferrous alloy is infiltrated into the packing member 34, the resiliency of the packing member 34 decreases, which may cause leakage of the molten metal.

According to the above embodiment, since the compact of the fibrous non-organic material is inserted in the compressed state between the outer tube 31 and the inner tube 33, relative displacement of the outer tube 31 and the inner tube 33 can be prevented by the frictional force generated by the repulsive force of the central portion 321 of the intermediate member 32. In addition, since the compact of the aforementioned fibrous non-organic material has high heat resistance, the aforementioned relative displacement preventing function can be maintained for a long period of time. Moreover, since the compact of the fibrous non-organic material is used in the compressed state, even if the molten metal is going to penetrate into the central portion 321 from the both longitudinal end portions of the molten metal feed pipe 30, it is difficult for the molten metal to penetrate into the compact having such an increased density.

In addition, the end portions 322 of the intermediate member 32 formed of the compact of the fibrous non-organic material can more reliably prevent molten metal from flowing into the gap between the circumferential ends of the central portion 321, which gap is almost unavoidably formed in the manufacturing process.

In addition, when the molten metal feed pipes 30 are connected to each other, the packing member 34 formed of the compact of the fibrous non-organic material is also inserted in the compressed state between the opposing end faces of the inner tubes 33. Thus, penetration of the molten metal into the intermediate member 32 through the gap between the end faces of the inner tubes 33 can be prevented.

As compared with a case where a special protective layer is provided on the outer tube 31 or the inner tube 33, the compact of the fibrous non-organic material can be implemented at a low cost. Namely, according to the above-described embodiment, the outer tube made of a ferrous material can be sufficiently protected and relative displacement of the outer tube 31 and the inner tube 33 can be prevented, while avoiding increase in production cost of the molten metal feed pipe 30.

Figure 2:
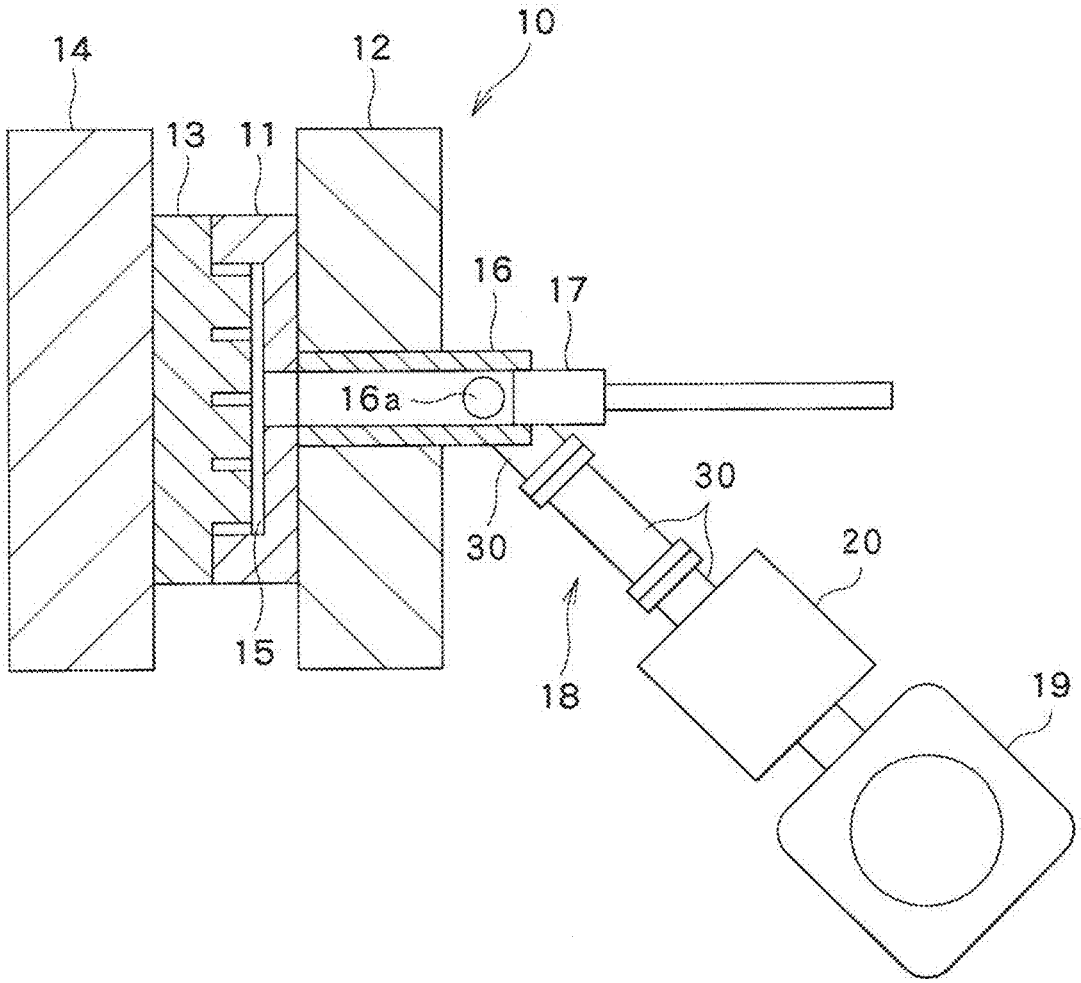
FIG. 2 is a schematic plan view of the nonferrous alloy casting system of FIG. 1.

In the casting system shown in FIGS. 1 and 2, since the molten metal always exists in the molten metal feed pipe 30, it is preferable to provide a heater (not shown) for maintaining the temperature of the molten metal in the molten metal feed pipe 30. In this case, if the heater is disposed inside the molten metal feed pipe 30, production cost and maintenance cost of the molten metal feed pipe 30 are increased, and the molten metal feed pipe 30 becomes less versatile because of its complicated structure. Thus, if a heater is provided, a heater easily removable from the molten metal feed pipe 30, such as a mantle heater or a jacket heater, is preferred.

The molten metal feed pipe 30 can be connected to the sleeve 16 or the furnace 19 using a connection joint (not shown) having a profile corresponding to that of the end of the molten metal feed pipe 30 and made of a material having erosion resistance. A gap between the not-shown connection joint and the molten metal feed pipe 31 may be sealed by the packing member 34.

Next, a method of fitting the inner tube 33 around which the central portion 321 of the intermediate member 32 is wound, into the outer tube 31 is described.

Firstly, the compact formed of the fibrous non-organic material, which constitutes the central portion 321 of the intermediate member 32, is compressed to reduce its thickness. Under this state, as shown in FIGS. 4(*a*) and 4(*b*), the compact is wound around the inner tube 33. At this time, an adhesive may be applied to the surface of the inner tube 33 or the central portion 321 so as to adhere the inner tube 33 and the central portion 321. Then, as shown in FIG. 4(*c*), a general-purpose masking tape 40 is wound around the central portion 321 helically, for example. The masking tape 40 wound under high tension assists in maintaining the compressed state of the central portion 321.

Then, a metal plate 41 is attached to one end of the assembly of the inner tube 33, the central portion 321 and the masking tape 40 (hereinafter referred to "assembly 33+321+40"); and a metal plate 42 is fixed onto the flange 31*a* on one end of the outer tube 31 by bolt/nut fastening using the bolt insertion holes for the screw bolts 35*a* formed in the flange 31*a*. A long bolt 43 is inserted through a through-hole formed in a central part of the metal plate 41, and the long bolt 43 having an external thread is screwed to an internal thread formed in the central part of the metal plate 42. By tightening the long bolt 43, the assembly 33+321+40 can be fitted into the outer tube 31. The fitting operation can be facilitated by using a slippery masking tape 40, or by heating the outer tube 31 before insertion of the assembly 33+321+40. The masking tape 40 (and also the adhesive when the inner tube 33 and the central portion 321 are adhered) is ashed to disappear by the heat applied when the molten melt feed pipe 30.

The above fitting method can be easily carried out with the use of inexpensive jigs (metal plates 41 and 42, long bolt 43, etc.). However, the fitting method is not limited to the above, and another method using, e.g., a press fitting machine is also possible.

In a case where the molten metal feed pipe 30 is a curved pipe, the central portion 321 of the intermediate member 32 is divided into a plurality of pieces in the tube axial direction. Each piece has a truncated fan-like shape such that each piece has a shape similar to a segment constituting a miter bend when it is applied onto the inner tube 33. The respective pieces of the central portion 321 are applied in the compressed state onto the inner tube 31 with an adhesive. Then, the general-purpose masking tape 40 is wound around the central portion 321 helically, for example, while a tension is given to the masking tape 40, in order to maintain the compressed state of the central portion 321. Thus, an assembly of the inner tube 33, the central portion 321 and the masking tape 40 (assembly 33+321+40) is formed. The assembly 33+321+40 is fitted into the outer tube 31.

Figure 5:
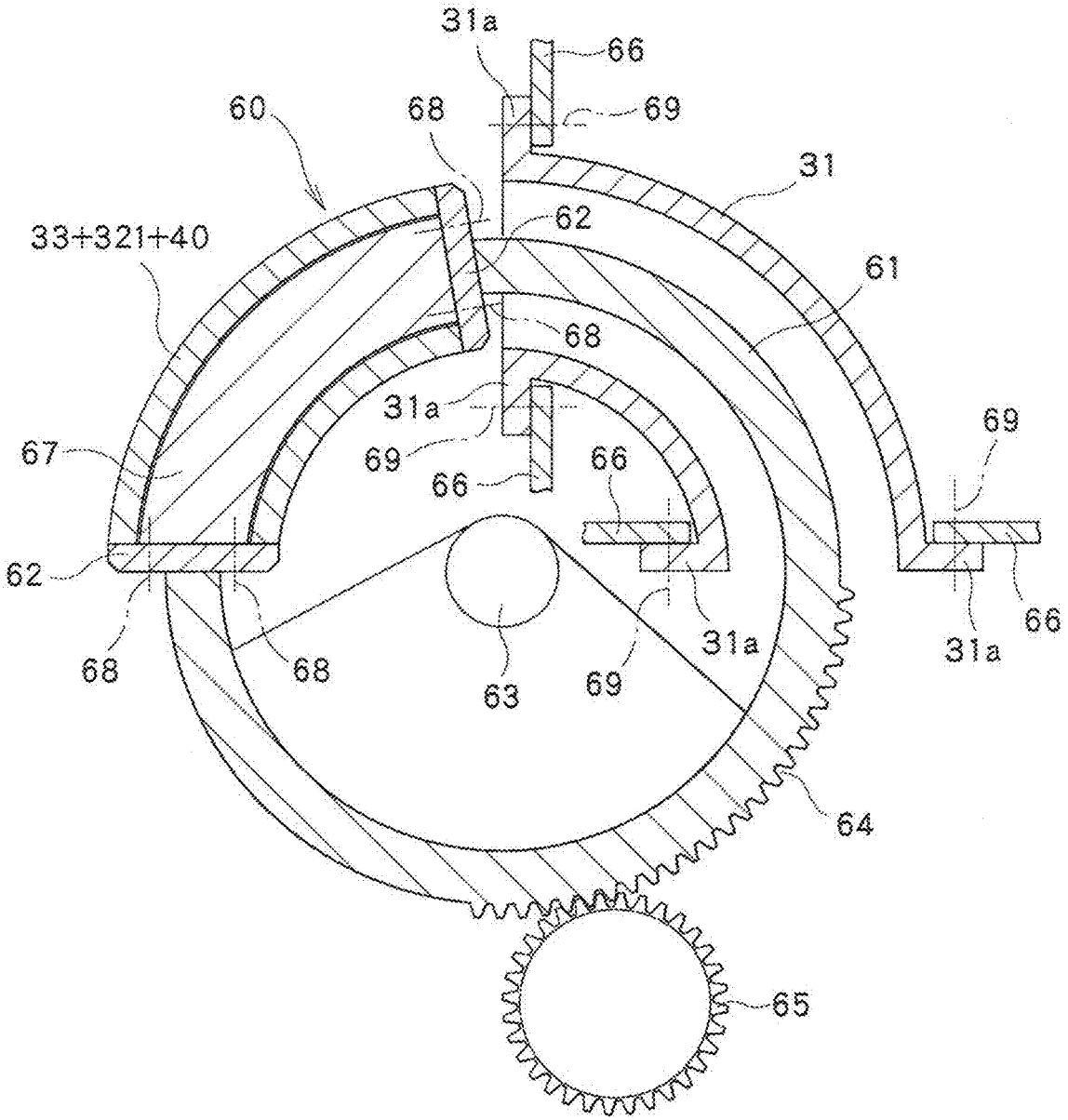
FIG. 5 is a cross sectional view showing a schematic structure of an apparatus for manufacturing the molten metal feed pipe as a bent pipe.

The fitting can be carried out with the use of a fitting apparatus 60, which is schematically shown in FIG. 5. The fitting apparatus 60 has an arcuate arm 61 having a central angle of about 270 degrees. Circular inner-tube fixing plates 62 are disposed on both ends of the arm 61. The arm 61 is supported by a bearing 63 such that the arm 61 is horizontally and vertically immovable, but is rotatable about an vertical axis (direction perpendicular to the sheet plane of FIG. 5). Teeth 64 are formed partially in an outer circumference of the arm 61. A gear wheel 65, which is driven by a not-shown drive motor, is meshed with the teeth 64.

The fitting apparatus 60 has a plurality of holding members 66 for holding the outer tube 31. The outer tube 31 can be fixed onto the holding members 66 by bolt/nut fastening 69 using the bolt insertion holes for the screw bolts 35*a* formed in the flange 31*a* on both ends of the outer tube 31.

A core bar 67 having an external diameter slightly smaller than an internal diameter of the inner tube 33 is inserted into the inner tube 33 of the assembly 33+321+40. Under this state, screw bolts 68 are inserted into through-holes formed in the inner tube fixing plate 62, and the screw bolts 68 are screwed into female threads formed in both end faces of the core bar 67. Thus, the inner tube 33 is fixed to the inner tube fixing plate 62. Under this state, by driving the gear 65, the assembly 33+321+40 is fitted into the outer tube 31. Thereafter, the screw bolts 68 are removed, and the outer tube 31 is removed from the holding members 66. In this manner, an assembly comprising the outer tube 31, the central portion 321 of the intermediate member 32 and the inner tube 33, which are coupled to one another, is completed.

Example

A test result about one example of the present invention is described herebelow. In the test, the casting system having the structure shown in FIGS. 1 and 2, and the molten metal feed pipes 30 having the structure shown in FIG. 3 are used. The outer tube 31 was formed of austenite stainless steel. As the intermediate member 32 and the packing member 34, a laminated body formed by laminating a plurality of mullite fiber sheets with vermiculite disposed between the sheets was used. The inner tube 31 was formed of sialon ceramics.

The external diameter of the inner tube 33 was smaller than the internal diameter of the outer tube 31 by 3 mm (1.5 mm in radius). The whole axial length of the inner tube 33 was smaller than the whole axial length of the outer tube 31 by 4 mm (2 mm on one side). As shown in FIGS. 4(*a*) and 4(*b*), the central portion 321 of the intermediate member 32, which was formed by cutting the rectangular laminated sheet having a thickness of 3.2 mm to have the length smaller than the whole axial length of the inner tube 33 by 10 mm, was wound around the inner tube 33, such that both ends of the central portion 321 were respectively located at positions apart from the both ends of the inner tube 33 by 5 mm. The sheet lamination direction of the laminated sheet constituting the central portion 321 was the thickness direction of the central portion 321 (i.e., the radial direction of the molten metal feed pipe 30). Then, as shown in FIG. 4(*c*), the general-purpose masking tape 40 was applied to the whole outer circumference of the central portion 321 of the intermediate member 32, which was wound around the inner tube 33. By using the jigs shown in FIG. 4(*d*), the inner tube 31 was fitted into the outer tube 31, such that the end face of the inner tube 33 was located inside the end face of the outer tube 31 by 2 mm in the longitudinal axial direction.

In addition, the end portion 322 of the intermediate member 32, which was formed by cutting the sheet layer having a thickness of 5 mm to have a ring shape, was fitted into a gap between the inner tube 33 and the outer tube 31 where the central portion 321 was not present. The sheet lamination direction of the laminated sheet constituting the end portion 322 was the thickness direction of the end portion 322 (i.e., the longitudinal axial direction of the molten metal feed pipe). Incidentally, the molten metal feed pipe 30 of a 90-degree bent pipe type was manufactured by the method described with reference to FIG. 5 (the detailed description thereof is omitted).

The holding furnace 19 for a molten aluminum alloy and the sleeve 16 of the casing apparatus (i.e., die-casting machine) were connected to each other by using the four molten metal feed pipes 30 having the aforementioned structure. By securely connecting the outer tubes 31 with the use of the screw bolts 35*a* passed through the flange 31*a* of the outer tubes 31 and the nuts 35*b* engaged with the respective screw bolts 35*a*, the adjacent molten metal feed pipes 30 were connected to each other. As shown in FIG. 3, the packing member 34, which was formed by cutting the sheet layer having a thickness of 6 mm to have a ring-like shape, was inserted between the adjacent molten metal feed pipes 31 (between the opposing faces of the inner tubes 33). Thus, the interference of the packing member 34 was 2 mm. The sheet lamination direction of the laminated sheet constituting the packing member 34 was the thickness direction of the packing member 34 (i.e., the longitudinal axial direction of the molten metal feed pipe).

A heating wire, not shown, was wound around the outer circumference of the outer tube 31, and the heating wire was covered with a heat insulating member, not shown. During casting, by heating the molten metal feed pipe 30 with the heating wire, lowering of temperature of the molten aluminum alloy was prevented.

300-shot castings were carried out by using a usual Al—Si—Cu based aluminum alloy substantially corresponding to ADC12 (JIS H5302). Although the molten metal feed pipes 30 were exposed to vibrations of the casting machine and heat of the molten aluminum throughout the 300-shot castings, no leakage of the molten aluminum from the connection between the molten metal feed pipes 30 was found.

What is claimed is:

1. An assembly for feeding a molten metal of a nonferrous alloy, comprising:

two molten metal feed pipes for feeding a molten metal of a nonferrous alloy connected to one another, each of the two molten metal feed pipes comprising:

an outer tube made of a ferrous material;

an inner tube made of a molten metal resistant material; and an intermediate member disposed between the outer tube and the inner tube in at least a central region of the molten metal feed pipe with respect to a longitudinal axial direction of the molten metal feed pipe, the intermediate member comprising a compact of a fibrous non-organic material;

wherein the intermediate member, positioned in the central region of the molten metal feed pipe with respect to the longitudinal axial direction of the molten metal feed pipe, is disposed between the outer tube and the inner tube with the intermediate member held in a state of being compressed by the outer tube and the inner tube in a radial direction of the molten metal feed pipe;

a fastener, connecting the two molten metal feed pipes with each other, that generates fastening force to press opposing end faces of the outer tubes of the two molten metal feed pipes against each other; and a packing interposed between opposing end faces of the inner tubes of the two molten metal feed pipes with the packing being compressed by the fastening force, the packing comprising a compact of a fibrous non-organic material.

2. The assembly according to claim 1, wherein, in each of the two molten metal feed pipes, the intermediate member, positioned in the central region of the molten metal feed pipe with respect to the longitudinal axial direction of the molten metal feed pipe, comprises a sheet shaped member wound on an outer circumference of the inner tube.

3. The assembly according to claim 1, wherein, in each of the two molten metal feed pipes, the intermediate member has a first portion positioned in the central region of the molten metal feed pipe with respect to the longitudinal axial direction of the molten metal feed pipe, and second portions positioned at both ends of the molten metal feed pipe with respect to the longitudinal axial direction of the molten metal feed pipe, wherein the first portion comprises a sheet shaped member wound on an outer circumference of the inner tube, and wherein the second portions each comprise annular member concentric with the molten metal feed pipe.

4. The assembly according to claim 1, wherein the fibrous non-organic material comprises at least one of alumina, silicon nitride, silica and zirconia.

5. The assembly according to claim 1, wherein the fibrous non-organic material has fibers having a diameter of from 1 μm to 500 μm.

6. The assembly according to claim 1, wherein the fibrous non-organic material of the packing comprises at least one of alumina, silicon nitride, silica and zirconia.

7. The assembly according to claim 1, wherein the fibrous non-organic material of the packing has fibers having a diameter of from 1 μm to 500 μm.

8. The assembly according to claim 1, wherein, in each of the two molten metal feed pipes, the intermediate member is constructed and arranged to generate a repulsive force as a result of being held in the state of being compressed, the repulsive force acting against compression of the intermediate member to prevent displacement of the inner tube relative to the outer tube.

9. The assembly according to claim 1, wherein, in each of the two molten metal feed pipes, the compact is interposed between the outer tube and the inner tube such that the compact compressed in the radial direction has a density within a range from 100 $kg/m^2$ to 250 $kg/m^2$.

* * * * *